US005775734A

United States Patent [19]

George, Jr.

[11] Patent Number: 5,775,734

[45] Date of Patent: Jul. 7, 1998

[54] INVESTMENT ADMINISTRATION SYSTEM

[76] Inventor: Ralph N. George, Jr., 62 Woodlake Dr., Piscataway, N.J. 08854

[21] Appl. No.: 691,612

[22] Filed: Aug. 2, 1996

[51] Int. Cl.[6] ..... B42D 15/00

[52] U.S. Cl. ..... 283/57; 283/67; 235/379

[58] Field of Search ..... 283/61, 57, 54, 283/58, 59, 67, 60.1, 117; 364/DIG. 1, DIG. 2; 235/379

[56] References Cited

U.S. PATENT DOCUMENTS 4,750,121 6/1988 Halley .
5,206,803 4/1993 Vitagliano .

*Primary Examiner*—Willmon Fridie, Jr.
*Attorney, Agent, or Firm*—Phillips, Lytle, Hitchock, Blaine & Huber LLP

[57] ABSTRACT

An investment administration system including a qualified money purchase plan is disclosed. The investment administration system accepts only after-tax employee contributions, direct and conduit rollovers from qualified plans and direct transfers from other qualified plans. The investment administration system does not accept employer contributions. A licensor is the central hub of the investment administration system. The licensor licenses institutional licensees, such as banks, and individual licensees, such as brokers, to market the investment administration system. The licensor provides the functions of a plan administrator/trustee for the investment administration system, provides marketing tools and information, generates standard forms, licenses the use of service marks and provides technical assistance to the licensees. Employers adopt the investment administration system through an institutional licensee or individual licensee, or become an employer licensee of the licensor. Each licensee may restrict the investment vehicles accessible to the employers of an employee to make the investment administration system more attractive to prospective participants.

26 Claims, 8 Drawing Sheets

INVESTMENT ADMINISTRATION SYSTEM

TECHNICAL FIELD

The invention relates generally to an investment administration system, and, more specifically, to a system having multiple licensees who utilize a common licensor as administrator of the system. All contributions are after-tax employee contributions or qualified transfers and participating employers are not required to provide contributions to match contributions by enrolled individual.

BACKGROUND OF THE INVENTION

Employers and employees benefit when an employer can offer its employees access to a qualified savings and retirement plan. Employees gain access to investment vehicles that might not otherwise be available to them, or access to investment vehicles at a lower cost. In addition, funds generated by a qualified savings plan are non-taxable until distribution. An employer engenders loyalty by offering such savings plans to its employees. Further, self-employed individuals benefit when their financial advisors can provide access to qualified savings plans.

Currently, so called 401(k) and 403(b) savings plans are the most popular savings vehicles offered by employers. These plans offer employees the opportunity to make voluntary pre-tax deferrals. However, certain classes of employers, such as non-profit organizations, are unable to establish 401(k) savings plans. In addition, many smaller employers do not wish to make matching contributions to their employees' 401(k) savings accounts, which is common. Self-employed individuals often use individual retirement accounts Keogh plans and simplified employee pensions.

A current trend in savings plans is to provide enrolled participants (i.e. employees) the ability to direct their own investments. Participants desire more control in directing their investments as information concerning investing and investment vehicles becomes readily available. Participants also desire access to the principal amount of their tax-deferred savings with little or no impact from income tax and investment redemption charges. An employee may also wish to transfer savings between plans or contribute funds above and beyond a standard payroll deduction.

Offering and administering qualified savings plans requires a significant dedication of resources. Marketing strategies must be designed, forms must be prepared for all administrative activities and significant reporting requirements are placed on a plan administrator/trustee of a qualified savings plan. For instance, offering a 401(k) savings plan involves providing an account summary every year to each participant. It would be advantageous if these "back office" functions could be handled through a centralized organization separate from the entity offering the qualified savings plan.

In addition, more employers would be interested in employee savings plans if the plans also offered low-cost professional record keeping and compliance resources, and offered a customized set of investment vehicles targeted to the demographics and characteristics of the employees.

Accordingly, there is a need for an investment administration system that is accessible to employers and financial advisors unable or unwilling to offer 401(k) and 403(b) savings plans; that provides participants with maximum control over the investment of their contributions; that eliminates the need for the employer to make any contribution; that allows licensees the ability to customize available investment vehicles to specific employers and their employees; and that removes "back office" functions to a centralized licensor.

BRIEF SUMMARY OF THE INVENTION

With parenthetical reference to the corresponding parts, portions or surfaces of the disclosed embodiment, merely for purposes of illustration and not by way of limitation, the invention is an investment administration system (e.g. 10) for administering participant (e.g. $P_{1-n}$) contributions (e.g. C, FS, RD, TA and B). The investment administration system comprises a participant account to hold participant contributions from each of a plurality of participants. Each participant is associated with an employer (e.g. $E_{1-n}$). A plurality of employers are enrolled through a licensee (e.g. $L_{1-n}$). The system includes a plurality of licensees, with each licensee adapted to offer each participant associated with an employer enrolled through the licensee access to a set of qualified investment vehicles (e.g. $IV_{1-n}$) selected by the licensee. All licensees are subscribed to the investment administration system through a single licensor (e.g. 11). The single licensor has a central plan administrator/trustee means (e.g. 15), a central marketing means (e.g. 12), a central forms means (e.g. 13) and a central technical resource means (e.g. 14). The plan administrator/trustee means includes a receiving means (e.g. 26) adapted to receive all participant contributions, and investment means (e.g. 28) to direct, under the instructions of each participant, each participant contribution corresponding to that participant into the qualified investment vehicles available to that participant selected by the participant's licensee, to compute and receive all proceeds (e.g. $PR_1$) generated by each participant contribution invested with the qualified investment vehicles, to distribute proceeds generated by each participant contribution invested in the qualified investment vehicles into an appropriate participant account, and a reporting means (e.g. 29) to prepare and disburse necessary information concerning each participant account, participant contribution, qualified investment vehicle and proceeds of each participant contribution invested with the qualified investment vehicles. The central forms means provides each licensee, employer and participant forms to assist in the administration of the investment administration system. The central marketing means generates marketing tools and information for each licensee and employer to assist in the marketing of the investment administration system. The central technical resource means provides training and support to the licensees concerning the operation of the investment administration system.

A goal of the invention is to provide a qualified savings plan where each contribution is an after-tax employee contribution, where employers are not required to make matching contributions, and where all proceeds of investments from the system are tax deferred until distribution.

Still another goal of the invention is to provide a single licensor to service the needs of multiple licensees of an investment administration system.

Still another goal of the invention is to remove all administration functions for an investment administration system to a single licensor to reduce the drain of resources on those who offer the investment administration system.

Yet another goal of the invention is to provide marketing tools and information, forms and technical resources to a group of licensees of an investment administration system.

DETAILED DESCRIPTION OF THE INVENTION

Figure 1:
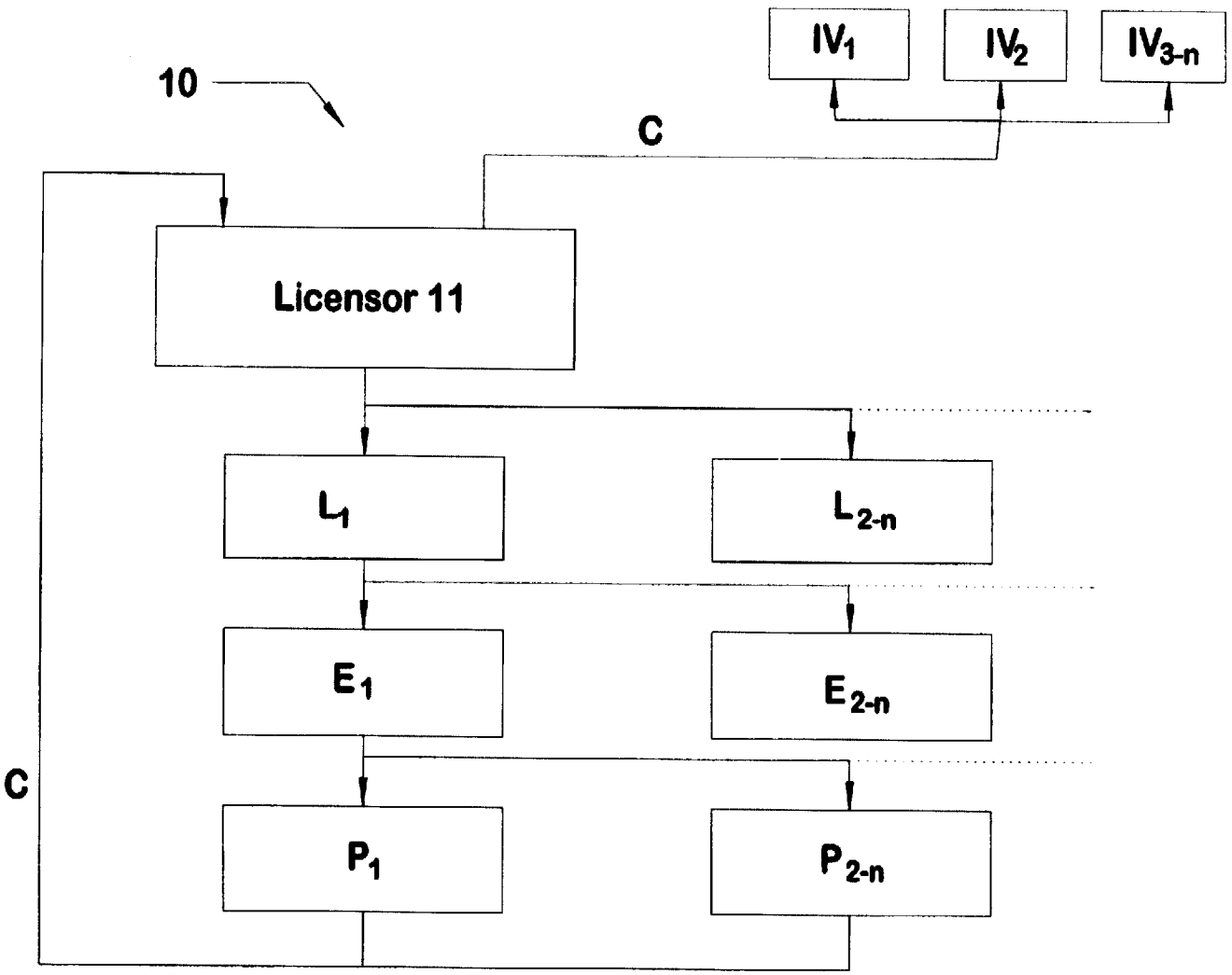
FIG. 1 is a schematic view of the investment administration system.

At the outset, it should be clearly understood that like reference numerals are intended to identify the same structural elements, portions or surfaces consistently throughout the several drawings figures, as such elements and portions may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention.

Adverting now to FIG. 1, a general schematic of the relationship between the parties of the investment administration system 10 is shown. Investment administration system 10 is an Internal Revenue Service approved tax-deferred savings plan meeting all the requirements of the Internal Revenue Code and Department of Labor Laws and Regulations. Specifically, investment administration system 10 complies with section 401(a) and related sections of the Internal Revenue Code and Title I and applicable regulations of ERISA. In general, investment administration system 10 comprises five general parts: licensor 11, a plurality of licensees $L_{1-n}$, a plurality of employers $E_{1-n}$ for each licensee $L_{1-n}$, a plurality of participants $P_{1-n}$ (i.e. employees) for each employer $E_{1-n}$ and a set of qualified investment vehicles $IV_{1-n}$ chosen by each licensee $L_{1-n}$ for each employer $E_{1-n}$. Licensor 11 is the central hub of investment administration system 10. Participants $P_{1-n}$ provide contributions C to licensor 11, which are invested in qualified investment vehicles $IV_{1-n}$. Any size employer may adopt investment administration system 10. However, it is likely to be more attractive to employers having fewer than 500 employees.

Figure 2:
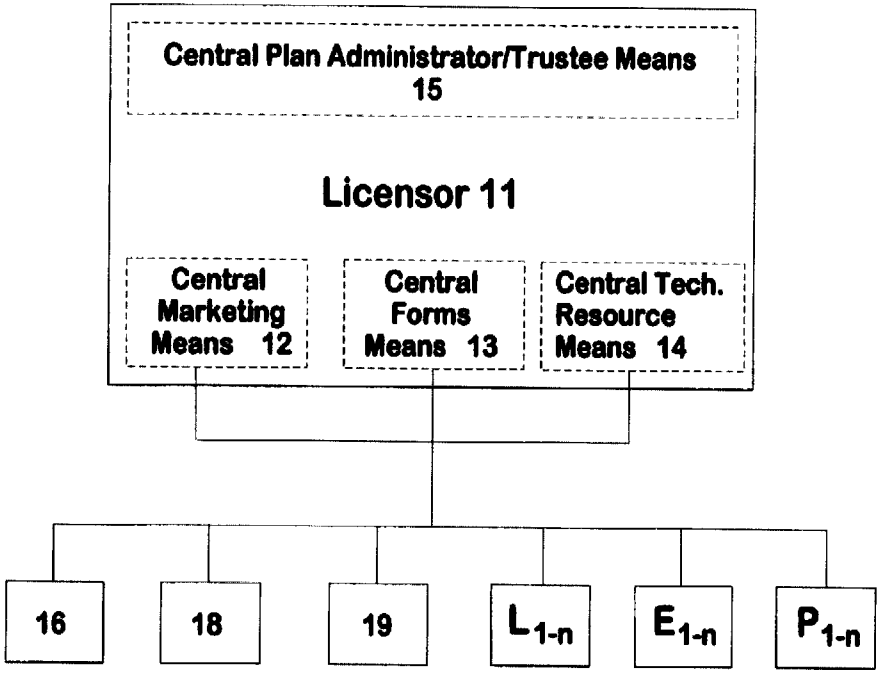
FIG. 2 is a schematic view of the interactions of the licensor.
Figure 3:
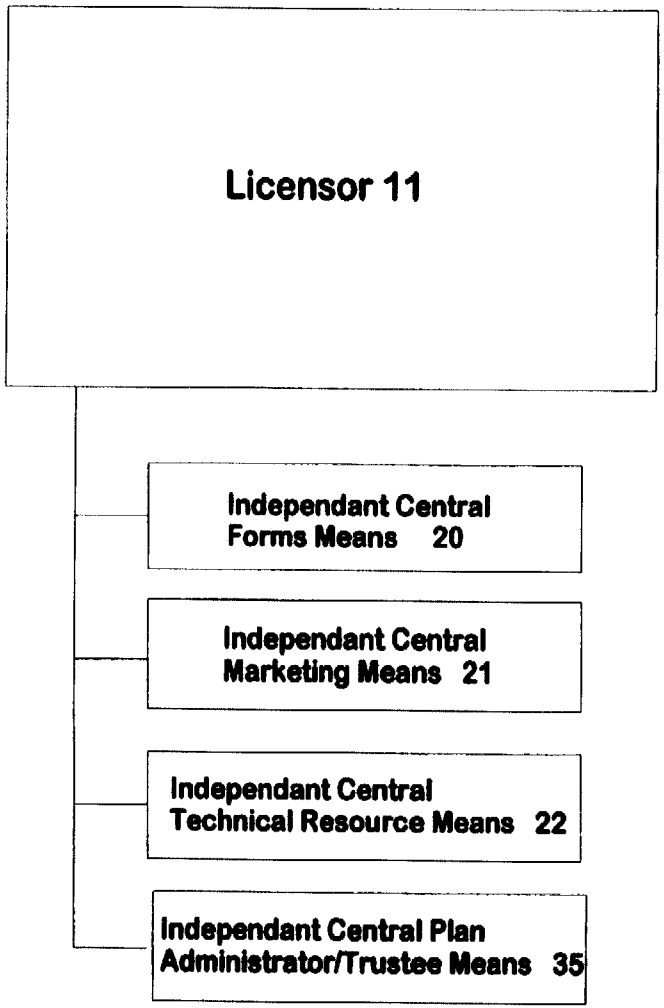
FIG. 3 is a schematic view showing out sourcing of licensor or functions.

Adverting to FIGS. 2 and 3, licensor 11 provides four key means: a central marketing means 12, a central forms means 13, a central technical resource means 14 and a central plan administrator/trustee means 15. Central marketing means 12 generates a core generic marketing plan for investment administration system 10 which is targeted at prospective licensees 16, existing licensees $L_{1-n}$, prospective employers 18, employers $E_{1-n}$, prospective participants 19 and participants $P_{1-n}$. It is contemplated that more than one licensee (e.g. $L_{1-n}$) will market investment administration system 10. The best mode of the invention contemplates a large number of licensees marketing investment administration system 10 to an even larger number of employers and participants.

A goal of central marketing means 12 is to interest prospective licensees 16 in marketing investment administration system 10. This interest can be generated by traditional marketing efforts such as publication of brochures and informational seminars, as well as non-traditional efforts such as a presence on the internet. Central marketing means 12 also provides marketing information to licensees $L_{1-n}$ to educate licensees $L_{1-n}$ concerning opportunities available through and changes in investment administration system 10. Central marketing means 12 provides marketing tools and information for prospective employers 18, employers $E_{1-n}$, prospective participants 19 and participants $P_{1-n}$, either through licensees $L_{1-n}$ or directly. These marketing tools and information assist licensees $L_{1-n}$ in recruiting participants and individuals to investment administration system 10.

A further goal of the present invention is to remove to a centralized location many of the time and resource consuming functions incurred when offering a qualified savings plan. Becoming a licensee of investment administration system 10 entitles licensees $L_{1-n}$ to utilize marketing tools and information developed by central marketing means 12, and thus realize a tremendous savings in resources. A second goal of the present invention is to provide licensees $L_{1-n}$ flexibility in their operations. To this end, licensees $L_{1-n}$ are able to customize the marketing tools and information provided by central marketing means 12, provided the changes are approved by central marketing means 12. The functions of central marketing means 12 can be provided by licensor 11 itself, or, as seen in FIG. 3, contracted out to an independent central marketing means 20. Thus, allowing licensor 11 to utilize the special talents of others to provide the highest quality of service to licensees $L_{1-n}$, employers $E_{1-n}$ and participants $P_{1-n}$.

A second component of the investment administration system 10 is central forms means 13 which provides standard forms to licensees $L_{1-n}$, employers $E_{1-n}$ and participants $P_{1-n}$. These forms are intended to assist in all administrative tasks of investment administration system 10 including, but not limited to, adoption of the system by employers $E_{1-n}$ and participants $P_{1-n}$, and changes in system participation by employers $E_{1-n}$ and participants $P_{1-n}$. As with the marketing tools and information provided by central marketing means 12, the forms provided by central forms means 13 can be customized, provided licensor 11 approves. Licensor 11 can choose to provide the functions of central forms means 13 itself, or contract out to an independent central forms means 21 to perform these functions. The central forms means further reduces the drain of resources on licensees $L_{1-n}$.

Investment administration system 10 also provides a central technical resource means 14 to coordinate the adoption of investment administration system 10 by licensees $L_{1-n}$, use by licensees $L_{1-n}$ of certain service marks to identify licensees $L_{1-n}$ as authorized providers of investment administration system 10 and training and support services for licensees $L_{1-n}$.

Figure 4:
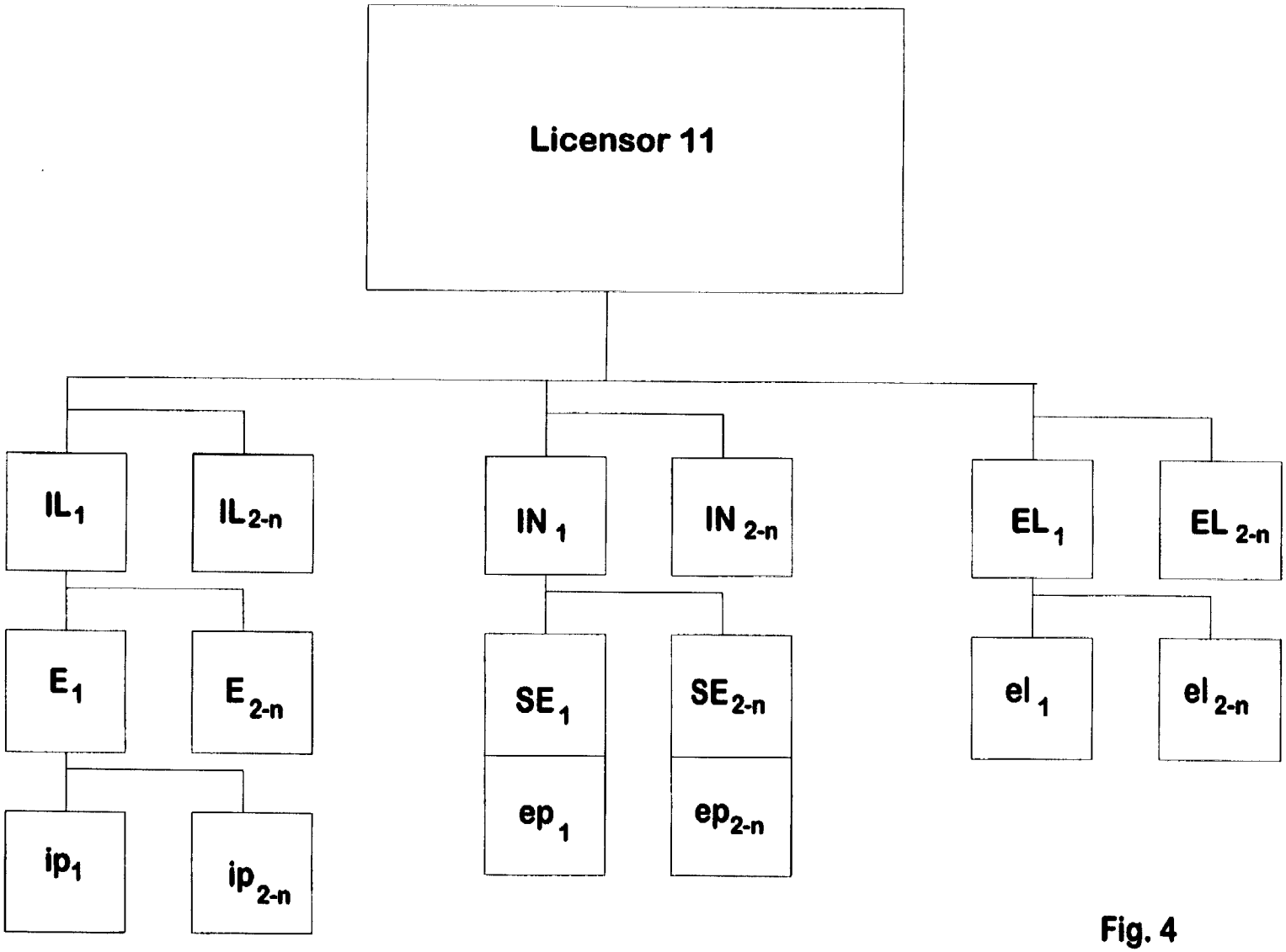
FIG. 4 is a schematic showing the different licensing schemes for the investment administration system.

Adverting to FIG. 4, the invention contemplates adoption of investment administration system 10 by three categories of licensees: institutional licensees $IL_{1-n}$, individual licensees $IN_{1-n}$ and employer licensees $EL_{1-n}$. Institutional licensees $IL_{1-n}$ are traditional, larger investment organizations such as banks, thrifts, credit unions, mutual fund companies, brokerage firms and insurance companies. Those who subscribe to investment administration system 10 through institutional licensees $IL_{1-n}$ are traditionally employers $E_{1-n}$ for the benefit of their employees, institutional participants $ip_{1-n}$.

A licensee may also be an individual who provides financial and asset management services such as a broker, registered financial planner, registered investment advisor or registered representative affiliated with a broker dealer. Individual licensees $IN_{1-n}$ market investment administration system 10 to their clients, normally self-employed individuals who rely on independent licensees $IN_{1-n}$ for investment advice. Each self-employed individual acts both as an employer $SE_{1-n}$, but also as an employee participant $ep_{1-n}$.

Institutional and individual licensees determine which investment vehicles the participants who enroll through them will have access to. Institutional and individual licensees may choose to offer qualified investment vehicles directly through themselves (e.g. a bank's own money market account) or vehicles offered through entities outside the institutional or individual licensee (e.g. a licensee bank designates certain mutual funds maintained by an independent mutual fund company).

Institutional and individual licensees, $IL_{1-n}$ and $IN_{1-n}$ respectively, are charged a yearly license fee for their participation in investment administration system 10. The license fee can be calculated based on the amount of enrolled individual contributions that flow into investment administration system 10 through the licensee during a year or on a percentage of the aggregate of all enrolled individual contributions in the investment administration system generated through the licensee. The invention contemplates many other systems to calculate license fees, and that the licensees will have the ability to switch between license fee calculation methods. Further, the invention contemplates transfer of the license to an entity that acquires or merges with an institutional or individual licensee.

Finally, the invention contemplates that employers can participate in investment administration system 10 directly through licensor 11 as an employer licensee $EL_{1-n}$ without an intervening institutional or individual licensee. Employee participants $el_{1-n}$ of an employer licensee $EL_{1-n}$ are offered access to a menu of investment vehicles generated by licensor 11. Licensor 11 retains for itself an appropriate license fee. Accordingly, employer licensees $EL_{1-n}$ are subject to very low fees.

The invention allows for effective marketing of investment administration system 10 by institutional licensees and individual licensees $IL_{1-n}$ and $IN_{1-n}$ by allowing the generation of a customized list of investment vehicles for each employer $E_{1-n}$. Examples of this flexibility are described below.

EXAMPLE 1

Figure 5:
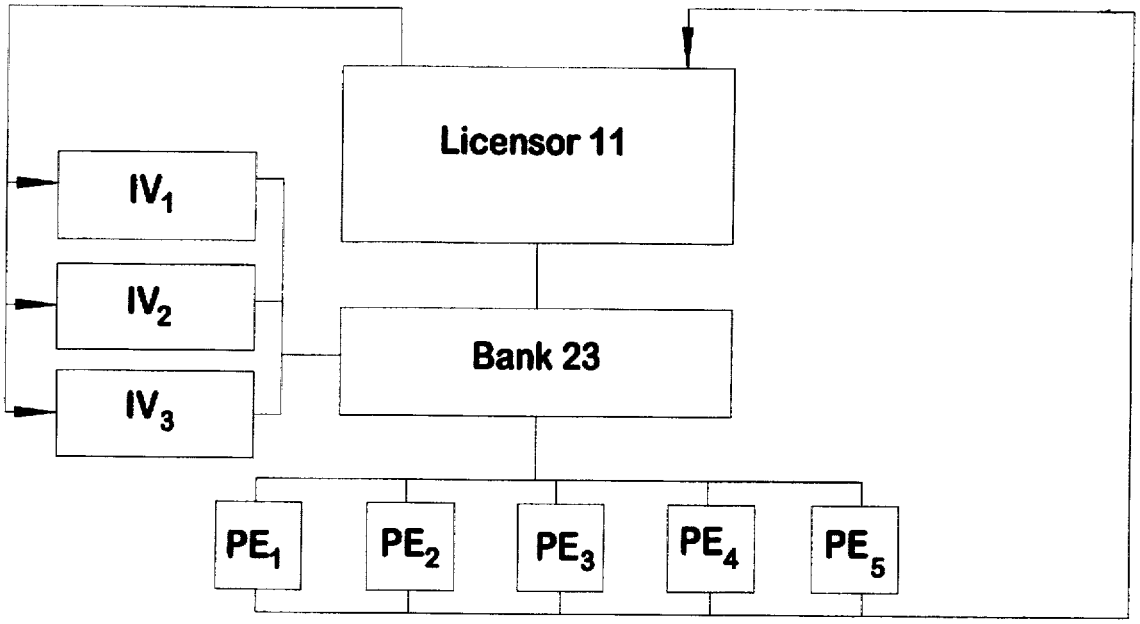
FIG. 5 is a schematic view of investment into three designated investment vehicles.

Adverting to FIG. 5, bank 23 is an institutional licensee desiring to increase funding of three investment vehicles it offers, $IV_{1-3}$, which are qualified investment vehicles. Accordingly, bank 23 may market investment administration system 10 to five prospective employers $PE_{1-5}$, offering access to investment vehicles $IV_{1-3}$ only.

EXAMPLE 2

Figure 6:
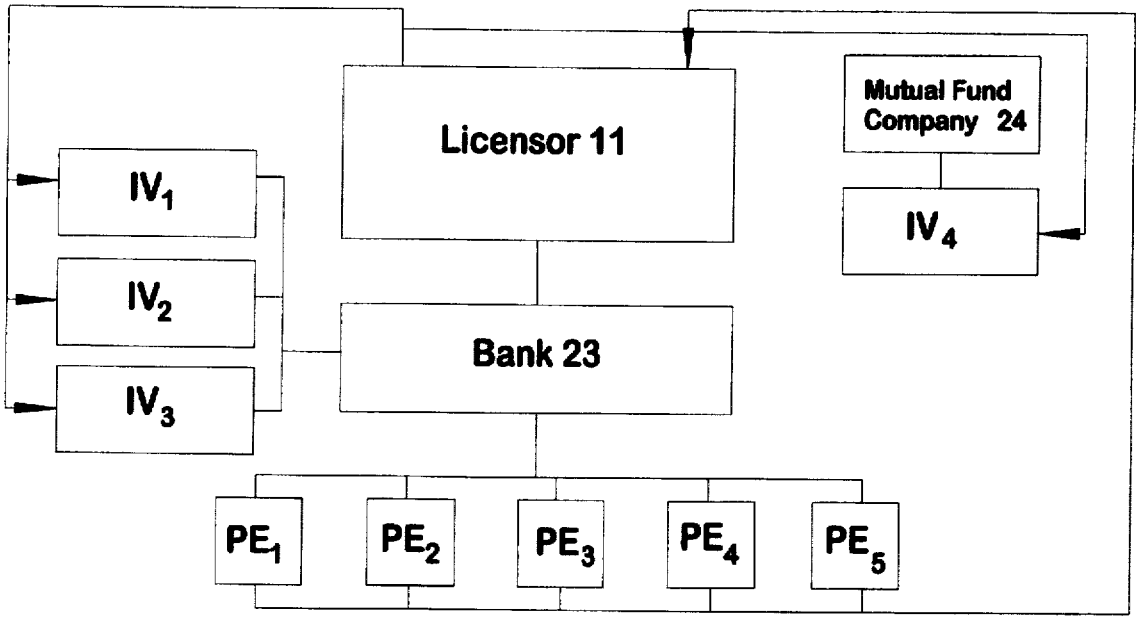
FIG. 6 is a schematic view of investment into four designated investment vehicles.

The investment administration system allows even greater flexibility in customizing investment vehicle selections. Adverting now to FIG. 6, the same conditions are present as in Example 1 except prospective employers $PE_{1-5}$ desire that their enrolled individuals also have access to fourth investment vehicle, $IV_4$, a mutual fund, which is a qualified investment vehicle, operated by mutual fund company 24 having no connection with bank 23. Bank 23 has the ability under investment administrative system 10 to include $IV_4$ as an accessible qualified investment vehicle.

EXAMPLE 3

Figure 7:
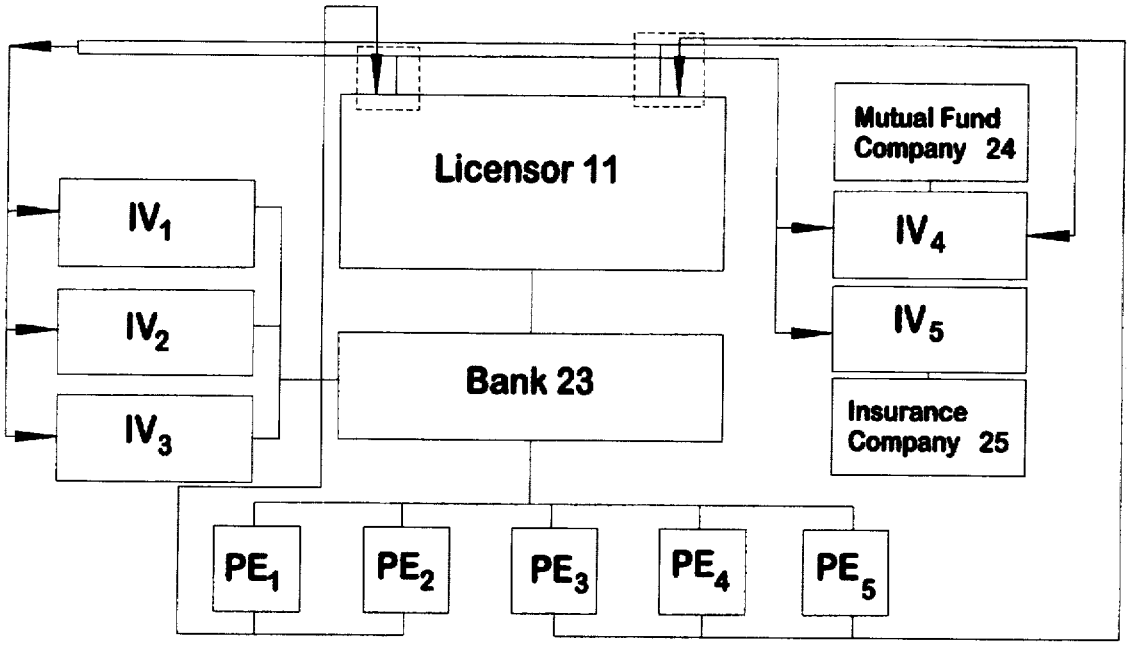
FIG. 7 is a schematic view of investment into five designated investment vehicles.

Adverting to FIG. 7, the same conditions are present as in Example 2, except prospective employers $PE_{1-2}$ desire their enrolled individuals to also have access to fifth investment vehicle, $IV_5$, a qualified investment vehicle offered by insurance company 25, as well as $IV_{1-4}$. Again, investment administration system 10 allows bank 23 to customize the investment vehicles available to enrolled individuals on a participant by participant basis, as long as each investment vehicle is a qualified investment vehicle.

EXAMPLE 4

Figure 8:
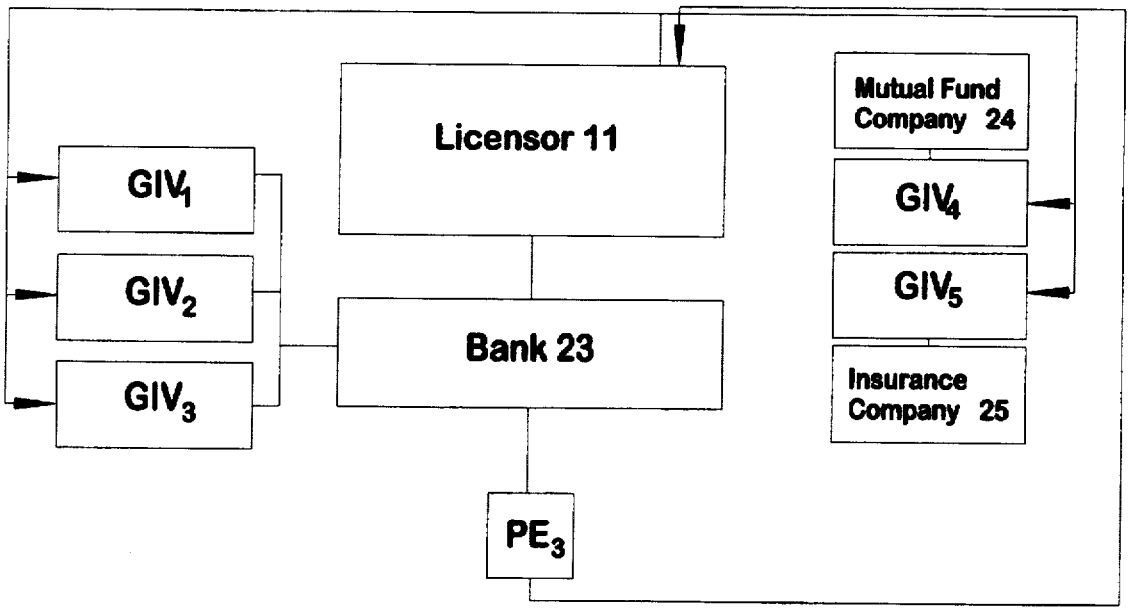
FIG. 8 is a schematic view of investment into five specific "green" investment vehicles.

Adverting to FIG. 8, bank 23 attempts to interest prospective employer $PE_1$ to adopt investment administration system 10. Prospective employer $PE_1$ strives to be environmentally conscious as part of its corporate mission. Bank 23 can create a portfolio of "green" qualified investment vehicles, $GIV_{1-5}$, and restrict access by the enrolled individuals to these "green" qualified investment vehicles.

Adverting back to FIG. 2, central technical resource means 14 processes all requests for a license of investment administration system 10 and passes the required information to centralized plan administrator/trustee means 15 for the establishment of desired enrolled individual accounts (described in greater detail below). Centralized technical resource means 14 also provides a license to each licensee $L_{1-n}$ of service marks which allow the licensees to identify themselves as authorized providers of investment administration system 10. Finally, central technical resource means 14 provides training for the licensees' staff who will work with investment administration system 10. The training programs can be seminars, in-house presentations, correspondence courses or computer programs. The help systems provided by central technical resource means 14 include telephone help-lines, internet assistance and on-site assistance. A licensor 11 may choose to provide the central technical resource means services itself, or contract out for these functions.

Central plan administrator/trustee 15 means provides all plan administration/trustee functions traditionally provided by a plan administrator/trustee of a qualified savings plan. However, in the current invention these functions are provided for multiple licensees who would normally assume these burdens individually. Accordingly, the resources of the licensees are conserved.

As shown in FIGS. 9–13, central plan administrator/trustee means 15 performs three general functions: receiving contributions through a receiving means 26, investment of contributions by an investment means 28 and reporting investment progress through a reporting means 29.

RECEIVING CONTRIBUTIONS

All funds received by receiving means 26 are contributions from enrolled individuals. Unlike 401(k) savings plans, no employer contributions are required. Investment administration system 10 thus provides an employee savings plan desirable for adoption by businesses who are unable to offer 401(k) and 403(b) plans, or do not wish to provide contributions to employees beyond wages and salaries.

Central receiving means 26 collects and processes all contributions from enrolled individuals destined for investment in investment administration system 10 in one of four ways. A programmed digital computer would be able to operate as central receiving means 26.

1. Payroll Deduction Contributions

Figure 9:
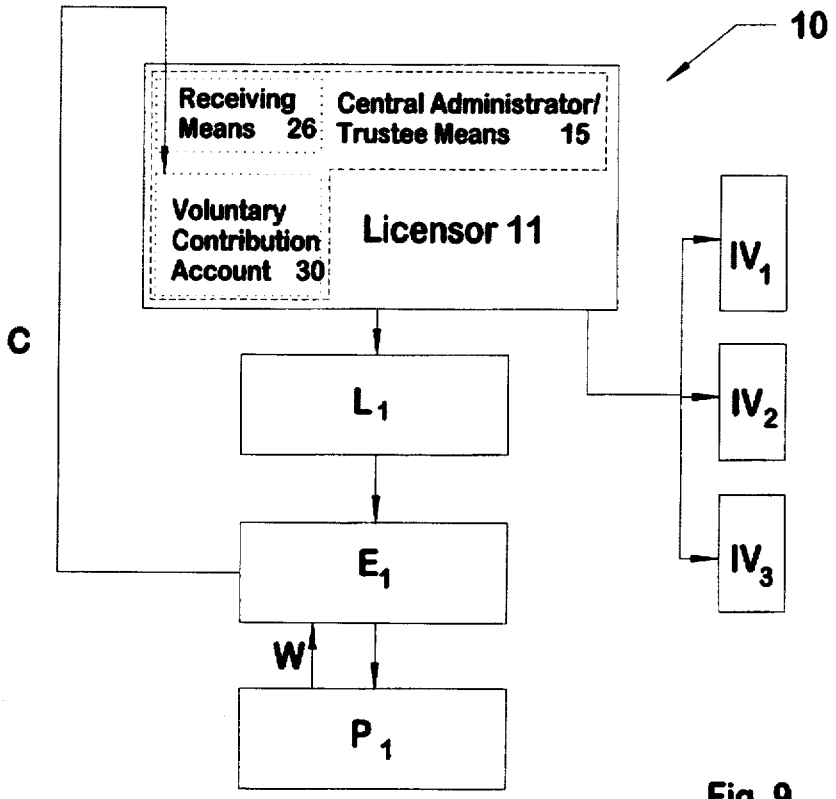
FIG. 9 is a schematic view tracing a payroll deduction contribution to the licensor and investment thereof.

Many employee savings plans contemplate payroll deductions as a method for the plan administrator/trustee to collect employee contributions. FIG. 9 shows the steps for collection of enrolled individual contributions by central plan administrator/trustee means 15 through payroll deductions. Participant $P_1$, an employee of employer $E_1$, authorizes employer $E_1$ to withhold a certain dollar value or percentage from his paycheck W for investment through the central plan administrator/trustee means 15. Participant $P_1$ authorizes the deduction using a form generated by the central forms means 13, which may or may not be customized by licensee $L_1$. It is the responsibility of employer $E_1$ to forward the appropriate contribution C corresponding to withholding W to central plan administrator/trustee means 15. Central plan administrator/trustee means 15 receives contribution C by a receiving means 26, for example direct deposit, wire transfer, or a check that represents the individual or collective payroll deduction amounts withheld from all participants, and places contribution C into the voluntary contribution account 30 of the participant account for participant $P_1$. A programmed digital computer would be able to operate as central receiving means 26.

2. Savings Conversion Contributions

Figure 10:
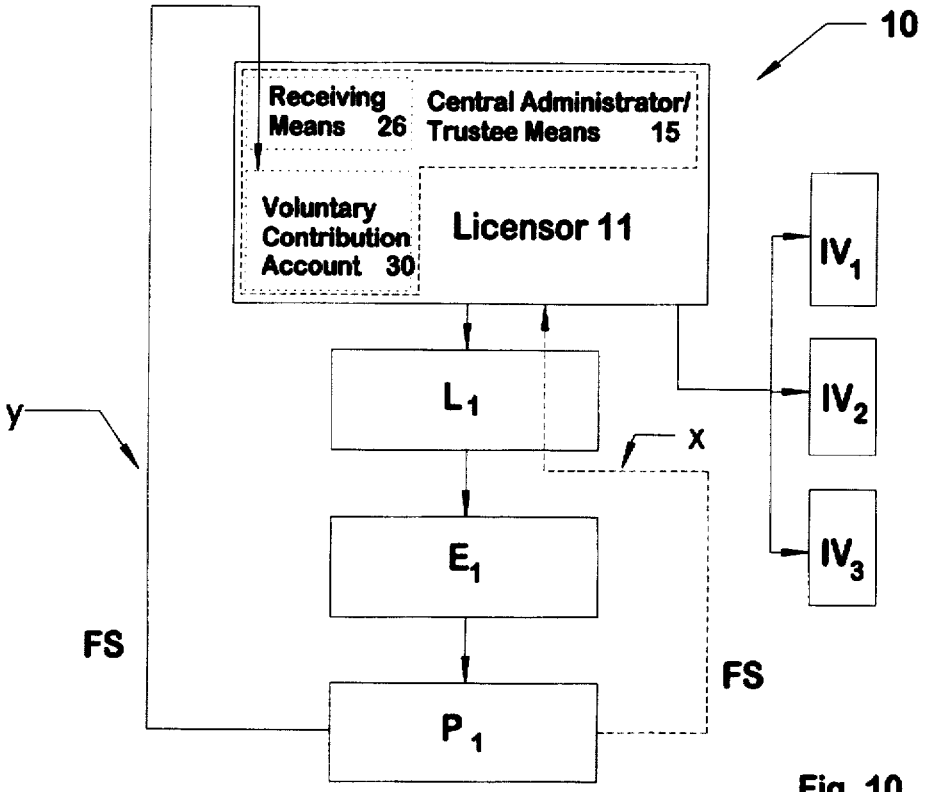
FIG. 10 is a schematic view showing savings conversion contributions to the investment administration system and investment thereof.

Participant $P_1$ may contribute other than wage or salary funds into investment administrative system 10 as shown in FIG. 10. Any non-tax shelter fund source FS can provide funds that qualify for investment into investment administration system 10. Examples are certificates of deposit, stocks, bonds, mutual finds, salary bonuses or inheritances. The licensee $L_1$ may choose whether savings conversion contributions must pass from participant $P_1$ through the licensee $L_1$ before reaching central plan administrator/trustee means 15, as shown by path X, or directly from participant $P_1$ to central plan administrator/trustee means 15, as show by path Y. Central plan administrator/trustee means 15 receives fund source FS by a receiving means 26, for example direct deposit, wire transfer, or by a check which represents the individual or collective savings conversion amounts paid to the system by one or more participants, and places fund source FS into the voluntary contribution account 30 of the participant account of participant $P_1$. Again, a programmed digital computer would be able to operate as central receiving means 26.

3. Rollover Contributions

Figure 11:
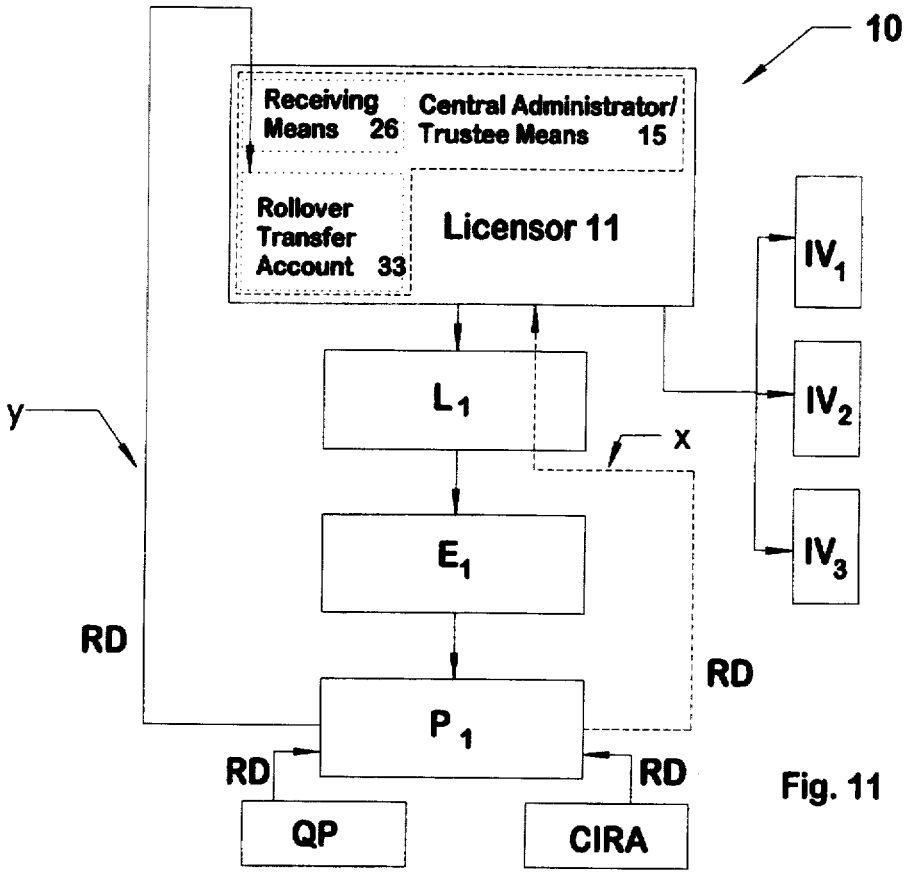
FIG. 11 is a schematic view showing rollover contributions to the investment administration system and investment thereof.

Participant $P_1$ may receive funds or property as an eligible rollover distribution from another qualified plan or conduit IRA and contribute such funds or property to investment administration system 10. That is, a rollover distribution to participant $P_1$ is normally taxable but will not be realized as taxable income if the taxable rollover distribution is reinvested in investment administration system 10, a qualified plan. Any rollover distribution may be either a traditional rollover, which must be completed within sixty (60) days after distribution, or a direct rollover between plan trustees. FIG. 11 shows how participant $P_1$ presents a traditional rollover distribution RD from either a qualified plan QP or conduit IRA CIRA to investment administration system 10. Licensee $L_1$ may choose whether rollover contribution RD must pass from participant $P_1$ through licensee $L_1$ before reaching central plan administrator/trustee means 15, shown by path X, or directly from participant $P_1$ to the central plan administrator/trustee means 15, as shown by path Y. Central plan administrator/trustee means 15 receives rollover distribution RD by receiving means 26, for example direct deposit, wire transfer, or by a check representing the individual rollover amount paid to the plan by a participant, and places rollover distribution RD into the rollover/transfer account 33 of enrolled individual account of participant $P_1$. Again, a programmed digital computer would be able to operate as central receiving means 26.

4. Transfer Contributions

Figure 12:
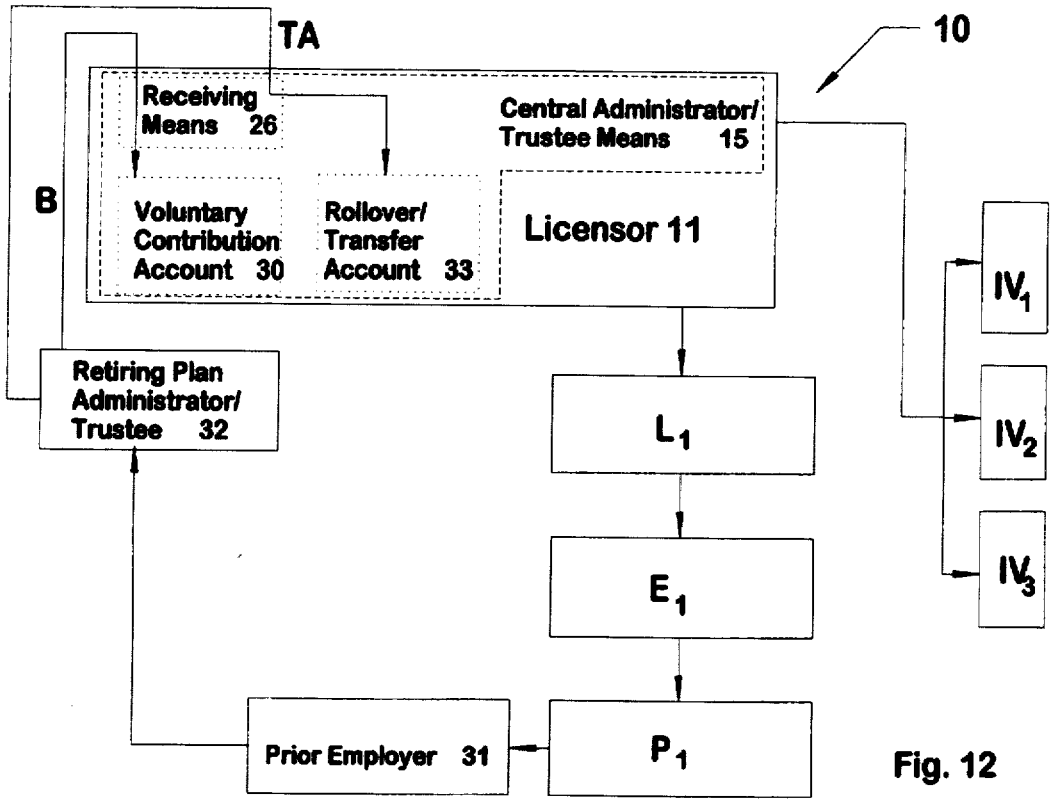
FIG. 12 is a schematic view showing transfer contributions to the investment administration system and investment thereof.

It is important for the current invention to accept transfer contributions from other qualified savings or retirement plans when attempting to interest an employer in changing employee savings plans. A change of plan administrator/trustee necessarily causes a transfer of contributions to the new plan administrator/trustee. Transfer contributions are significantly different than rollover contributions in that both taxable amounts and basis (i.e., previously taxed funds or property), are permitted to be transferred. It is important that investment administration system 10 is a qualified plan able to accept such transfer contributions. Otherwise, it would be difficult to entice an employer with an established employee savings plan to switch to investment administration system 10 as its employees would be unable to transfer the total value of their savings, and would be forced to accept distributions. FIG. 12 shows how central plan admninistrator/trustee means 15 obtains both taxable amounts and basis from a transfer contribution. Participant $P_1$, or his prior employer 31, instructs retiring plan administrator/trustee 32 to transfer all assets including taxable amounts TA and basis B, to central plan administrator/trustee means 15. Central plan administrator/trustee 15 receives taxable amounts TA and basis B by receiving means 26, for example direct deposit, wire transfer, or by retitling of an asset, and places basis B into the voluntary contribution account 30 of the participant account of participant $P_1$ and places taxable amounts TA into the rollover/transfer account 33 of the participant account of participant $P_1$. Taxable amounts TA are segregated to recognize no basis is applied against these amounts.

INVESTMENT OF CONTRIBUTIONS

Figure 13:
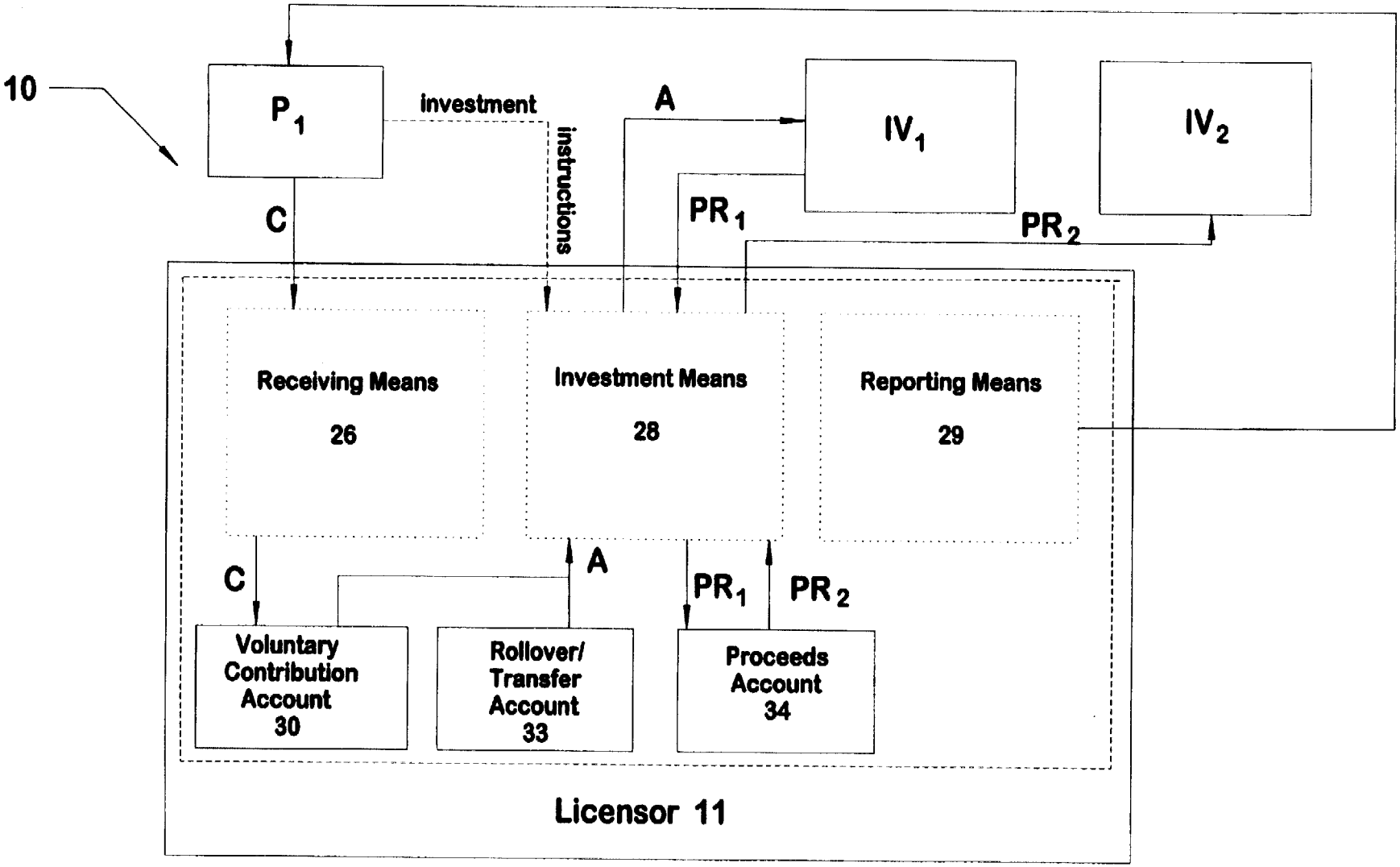
FIG. 13 is a schematic showing receipt of a contribution by the investment administration system, investment of an amount by the investment administration system, repatriation of proceeds from investments into the investment administration system, and reinvestment of proceeds.

The second function of central plan administrator/trustee means 15 is to invest employee contributions within the restrictions set by each licensee as directed by each enrolled individual through investment means 28. FIG. 13 shows the steps of a standard receipt and investment by central plan administrator/trustee means 15. C can be a payroll deduction contribution, savings conversion contribution or rollover contribution. Receiving means 26 accepts contribution C and channels it into the voluntary contribution account 30 of participant $P_1$. If C had been a transfer contribution, receiving means 26 would have channeled a portion representing basis to voluntary contribution account 30 and the remaining portion, representing a transfer amount, into the rollover/transfer account 33 of participant $P_1$.

Investment means 28 follows the instructions of participant $P_1$, removes from voluntary contribution account 30 and rollover/transfer account 33 an amount A for investment and channels it to qualified investment vehicle $IV_1$. The instructions must be within the restrictions established by licensee $L_1$. That is, participant $P_1$ can not direct investment means 28 to invest its contributions with an investment vehicle not selected by licensee $L_1$. As mentioned earlier, the types of investment vehicles to which a licensee may offer access are nearly limitless. The only restriction is that each investment vehicle must be a qualified investment vehicle. Investment administration system 10 contemplates that one qualified investment vehicle permits access by a participant to a portion of his savings in the form of a loan. Such an investment is a qualified investment vehicle, as interest is being charged. However, these loans allow participants access to their accumulated savings without incurring penalties for early withdrawal or the occurrence of a taxable event.

Profits $PR_1$ realized from the investment of amount A are computed and received by investment means 28 and channeled to proceeds account 34. Proceeds account 34 is similar to rollover/transfer account 33 in that it holds funds subject to taxation upon distribution. Profits can be reinvested at the direction of participant $P_1$. Profits $PR_2$, which may be more or less than profits $PR_1$, are removed from proceeds account 34 by investment means 28 and channeled to qualified investment vehicle $IV_2$.

REPORTING INVESTMENT PROGRESS

One significant drain of resources of a plan administrator/trustee is meeting the regulated reporting requirements for qualified savings plans. A significant administrative burden is taken from the institutional and individual licensees by having central plan administrator/trustee means 15 through a reporting means 29 handle these reporting functions. As the regulations currently stand, statements must be provided to each participant and employer at least once a year.

Adverting to FIG. 3, Licensor can choose to provide the functions of central plan administrator/trustee means 15 itself or contract out to an independent central plan administrator/trustee means 35.

MODIFICATIONS

The invention is not limited to the previously disclosed embodiments. For example, although specific qualified investment vehicles have been disclosed as part of the invention, any qualified investment vehicle is proper. In addition, the invention contemplates the investment administration system establishing separate, but parallel plans, for an individual employer, an individual licensee, grouped employers, grouped licensees or a combination of individual employees and licensees with groups of employers and licensees. Therefore, while preferred forms of the holdown shoe have been shown and described, and various changes and modifications therein discussed, persons skilled in the art will readily appreciate that various additional changes and modifications may be made without departing from the spirit of the invention.

We claim:

1. An investment administration system for administering participant after-tax contributions, comprising:

a participant account to hold said participant contributions for each of a plurality of participants, each participant being associated with an employer;

a plurality of said employers, each employer enrolled through a licensee;

a plurality of licensees, each said licensee adapted to offer each said participant who is associated with an employer enrolled through said licensee access to a set of qualified investment vehicles selected by said licensee;

each said licensee subscribed through a single licensor;

said licensor having central plan administrator/trustee means, central marketing means and central technical resource means;

said plan administrator/trustee means including a receiving means adapted to receive all said participant contributions, an investment means adapted to direct, under the instructions of each participant, each said participant contribution corresponding to that participant into any of said qualified investment vehicles available to that said participant selected by said licensee that said participant's employer is enrolled through, to compute and receive all proceeds generated by each said participant contribution invested with said qualified investment vehicles, to disburse proceeds generated by each said participant contribution invested in said qualified investment vehicles into an appropriate participant account, and a reporting means adapted for prepare and disburse necessary information concerning each participant account, participant contribution, qualified investment vehicle, and proceeds of each said participant contribution invested with said qualified investment vehicles;

said central marketing means adapted to generate for use by said licensees and employers marketing tools and information to assist in the marketing of the investment administration system; and said central technical resource means adapted to provide training and support to said licensees regarding the operation of said investment administration system.

2. The investment administration system as set forth in claim 1 wherein at least one employer employs less than 500 individuals.

3. The investment administration system as set forth in claim 1 wherein each licensee can be an institutional licensee, an individual licensee or an employer licensee.

4. The investment administration system as set forth in claim 1 wherein each said participation contribution can be one, or a combination, of the following: after tax payroll contribution, rollover from a qualified plan or conduit individual retirement account, or transfer from a qualified plan.

5. The investment administration system as set forth in claim 3 wherein no contribution is made to said investment administration system by any employer.

6. The investment administration system as set forth in claim 1 wherein one said qualified investment vehicle available to each said participant is a loan to said participant, the maximum amount of said loan based on the value of said participant's accounts.

7. The investment administration system as set forth in claim 3 wherein each licensee pays a subscription fee to subscribe to said license.

8. The investment administration system as set forth in claim 7 wherein said subscription fee for each licensee that is an individual licensee is based on the amount of participant contributions contributed to said investment administration system through that said individual licensee.

9. The investment administration system as set forth in claim 7 wherein said subscription fee for each licensee that is an institutional licensee is based on the amount of participant contributions contributed to said investment administration system through that said institutional licensee.

10. The investment administration system as set forth in claim 7 wherein said subscription fee for each licensee that is an individual licensee is based on the average annual balance of said participant accounts contributed to said investment administration system through each said individual licensee.

11. The investment administration system as set forth in claim 7 wherein said subscription fee for each licensee that is an institutional licensee is based on the average annual balance of said participant accounts contributed to said investment administration system through each said institutional licensee.

12. The investment administration system as set forth in claim 1 wherein FDIC insured vehicles, stocks, bonds, futures, mutual funds, annuities, life insurance and real property are qualified investment vehicles.

13. The investment administration system as set forth in claim 1 wherein said investment administration system includes an employee pension benefit plan pursuant to Title I of ERISA.

14. An investment administration system for participant contributions, comprising:

at least one participant account to hold said participant contributions for each of a plurality of participants, each participant being an employee associated with an employer;

a plurality of said employers, each employer enrolled through a licensee;

a plurality of licensees, each said licensee adapted to offer to each said participant who is associated with an employer enrolled through that said licensee access to a set of qualified investment vehicles selected by said licensee;

each said licensee subscribed through a single licensor;

said licensor having central plan administration/trustee means, central marketing means, central forms means and central technical resource means;

said plan administrator/trustee including receiving means for receiving each said participant contribution;

investment means for investing, under the direction of each said participant, each said participant contribution with one or more qualified investment vehicles from said set of qualified investment vehicles selected by said licensee said participant's employer is enrolled through, and to compute and receive proceeds generated by each said enrolled individual contribution invested with said qualified investment vehicles and to disburse proceeds generated by each said participant contribution invested with said qualified investment vehicles into the appropriate participant account; and reporting means to prepare and disburse necessary information concerning each participant account, each participant contribution, each qualified investment vehicle, and the proceeds of each said participant contribution invested with said qualified investment vehicles.

15. The investment administration system as set forth in claim 14 wherein at least one employer employs less than 500 individuals.

16. The investment administration system as set forth in claim 14 wherein each licensee can be an institutional licensee, an individual licensee or an employer licensee.

17. The investment administration system as set forth in claim 14 wherein each said participant contribution can be one, or a combination, of the following: after tax payroll contribution, rollover from a qualified plan or conduit individual retirement account, or transfer from a qualified plan.

18. The investment administration system as set forth in claim 17 wherein no contribution is made to said investment administration system by any employer.

19. The investment administration system as set forth in claim 14 wherein one said qualified investment vehicle available to each said participant is a loan to said participant, the maximum amount of said loan based on the value of said participant's accounts.

20. The investment administration system as set forth in claim 17 wherein each licensee pays a subscription fee to subscribe to said license.

21. The investment administration system as set forth in claim 20 wherein said subscription fee for each licensee that is an individual licensee is based on the amount of participant contributions contributed to said investment administration system through that said individual licensee.

22. The investment administration system as set forth in claim 20 wherein said subscription fee for each licensee that is an institutional licensee is based on the amount of participant contributions contributed to said investment administration system through that said institutional licensee.

23. The investment administration system as set forth in claim 20 wherein said subscription fee for each licensee that is an individual licensee is based on the average annual balance of said participant accounts contributed to said investment administration system through each said individual licensee.

24. The investment administration system as set forth in claim 14 wherein said subscription fee for each licensee that is an institutional licensee is based on the average annual balance of said participant accounts contributed to said investment administration system through each said institutional licensee.

25. The investment administration system as set forth in claim 14 wherein FDIC insured vehicles, stocks, bonds, futures, mutual funds, annuities, life insurance and real property are qualified investment vehicles.

26. The investment administration system as set forth in claim 14 wherein said investment administration system includes an employee pension benefit plan pursuant to Title I of ERISA.

* * * * *